United States Patent [19]

Kasamura

[11] 4,381,147

[45] Apr. 26, 1983

[54] APPARATUS FOR FORMING PLURAL IMAGES FROM A LATENT IMAGE

[76] Inventor: Toshirou Kasamura, c/o Canon Kabushiki Kaisha, 30-2, 3-chome, Shimomaruko, Ohta-ku, Tokyo, Japan

[21] Appl. No.: 191,002

[22] Filed: Sep. 26, 1980

[51] Int. Cl.[3] ..... G03G 15/00

[52] U.S. Cl. ..... 355/14 R; 355/3 R; 355/3 TE; 355/14 TR

[58] Field of Search ..... 355/14 R, 3 R, 14 SH, 355/3 SH, 3 BE, 3 TE, 14 TE, 16

[56] References Cited

U.S. PATENT DOCUMENTS

| | | | |
|---|---|---|---|
| Re. 29,179 | 4/1977 | Davidge et al. | 355/14 |
| 4,099,860 | 7/1978 | Connin | 355/14 C |
| 4,142,792 | 3/1979 | Satomi et al. | 355/14 |
| 4,270,860 | 6/1981 | Tsuda et al. | 355/14 R |
| 4,286,865 | 9/1981 | Satomi et al. | 355/14 CU |

*Primary Examiner*—A. C. Prescott

*Attorney, Agent, or Firm*—Fitzpatrick, Cella, Harper & Scinto

[57] ABSTRACT

In the conventional electrophotographic apparatus, the formation of plural images on transfer materials from an original has been achieved by forming a latent image anew on a latent image bearing member for each image to be obtained. Such repeated latent image formation is however unnecessary in an apparatus in which a latent image formed on a latent image bearing member is utilized for forming plural images on transfer materials. Such apparatus allows a faster imaging forming speed because of absence of time required for such repeated latent image formation.

This invention provides such apparatus capable of identifying, when the process of image formation on the transfer materials is interrupted, the condition of the latent image on the latent image bearing member according to the period of such interruption and judging whether or not to reuse the latent image at the re-start of the image forming process, thereby enabling to obtain the images of high quality on the transfer materials without loss and within a shortest time.

5 Claims, 6 Drawing Figures

APPARATUS FOR FORMING PLURAL IMAGES FROM A LATENT IMAGE

BACKGROUND OF THE INVENTION

1. Field of the Invention

The present invention relates to an improvement in an apparatus capable of forming plural images on transfer materials from a single latent image formed on a latent image bearing member.

2. Description of the Prior Art

For the purpose of producing plural images from a single latent image formed on a latent image bearing member, there is already known a process of forming a primary latent image on a screen-shaped photosensitive member (hereinafter called screen) and repeating a step of forming a secondary latent image on a transfer material by modulating ion flow by means of the electric field generated in the apertures of said screen by said primary latent image or repeating a step of forming such secondary latent image on an insulating drum. Said secondary latent image formed on the transfer material is developed and fixed thereon while a secondary latent image formed on said insulating drum is developed, then transferred onto a transfer material and fixed thereon. The apparatus utilizing such screen is capable of ion modulations of several tens to several hundred times with a primary latent image on the screen if it is not easily deteriorated by such modulating step.

In addition to the foregoing there are also known a process of forming a latent image on a conventional layer-structured photosensitive member and repeating the steps of image development and image transfer so as not to attenuate said latent image, and a process of forming a magnetic latent image, instead of the electrostatic latent image, on a magnetic recording member and repeating the steps of image development and image transfer in a similar manner.

In the following description of the present invention, reference will be made to an image forming apparatus utilizing a screen as explained in the foregoing.

The screen to be employed in the present invention is composed of a layered structure of electroconductive members and photoconductive or insulating members having a plurality of minute apertures, is adapted to form a primary latent image corresponding to the image of an original through the steps of electrostatic charging and exposure to light image of said original, and is utilized for forming a secondary latent image on a copy material capable of bearing electrostatic charge thereon by ion modulation in which the passage of ion flow through said apertures is controlled according to the electric field pattern formed in said apertures by said primary latent image. Such electrophotographic process is already disclosed for example in the U.S. Pat. No. 3,582,206 corresponding to the Japanese Patent Publication No. Sho48-5063.

The electrophotographic process utilizing such screen allows, depending upon the layered structure of the screen, secondary latent images to be obtained on copying materials consecutively by plural ion modulation steps on a single primary latent image. Consequently a copying apparatus utilizing such screen is capable of consecutive image formations on plural copy sheets once a latent image is formed on said screen.

The conventional copiers generally interrupt the copying operation in case of a machine trouble such as paper jamming in the course of copying process and form the latent image anew on the photosensitive member after such trouble is resolved. Also the copiers utilizing the above-mentioned screen for consecutive copying from a single latent image effect the formation of the primary latent image anew after the copying operation is interrupted by a machine trouble such as paper jamming. Such reformation of the primary latent image is quite inefficient despite the fact that such apparatus has an ability of forming the copy images consecutively from a single latent image. Such drawback is not limited to the process utilizing the above-mentioned screen but also exists in other processes as explained in the foregoing.

SUMMARY OF THE INVENTION

The object of the present invention is to provide an image forming apparatus not associated with the above-mentioned drawback of the prior art and capable of efficiently providing plural images from a single latent image, further capable of efficiently forming images of high quality.

The above-mentioned object of the present invention is achieved by an image forming apparatus forming a latent image on a latent image bearing member by means of latent image forming means and utilizing said latent image plural times for forming plural images on members other than said latent image bearing member, said apparatus being featured in measuring, in case the image forming process is interrupted, the period of such interruption and forming the latent image anew on the image bearing member if the measured period exceeds a tolerable period of the latent image on the latent image bearing member or continuing the image forming process without new latent image formation if the measured time is shorter than said tolerable period of the latent image.

The timer means utilized for measuring the period of said interruption can be composed for example of a counter for counting clock pulses generated from the start to the end of said interruption, the count of said counter being stored for example in a random access memory and converted into time. The temperature change in a heat generating unit such as the fixing unit may also serve this purpose, but an electric measurement is preferred in consideration of the accuracy.

In case of a machine trouble requiring a prolonged interruption of copying cycle, the primary latent image on the image bearing member is attenuated depending on the constituent materials thereof and the circumferential conditions. Such attenuated primary latent image is unable to provide a satisfactory image, and the formation of a new primary latent image becomes advantageous only in such case. The apparatus of the present invention determines the necessity for new latent image formation through the comparison of the interrupted period of imaging process with a predetermined time, thereby avoiding to continue the imaging process with the latent image attenuated beyond the tolerable extent, and still avoids the waste in time for unnecessary latent image formation by continuing to use the existing primary latent image if said interruption is shorter than said predetermined time in which said latent image is still adequate for reuse.

The latent image bearing member includes, in addition to the conventional layer-structured photosensitive member and the screen, other drums and webs adapted for bearing electrostatic or magnetic latent image, such as an insulating or magnetic drum, and the above-mentioned image forming apparatus includes copiers and recording apparatus.

DESCRIPTION OF THE PREFERRED EMBODIMENTS

The present invention will now be clarified in detail with reference to an embodiment in which it is applied to a copying apparatus utilizing a screen as the latent image bearing member.

Figure 1:
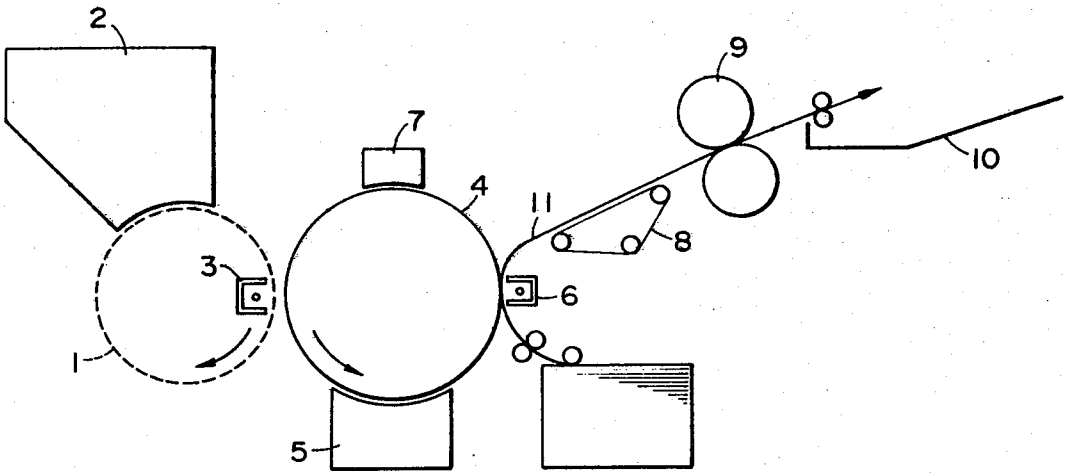
FIG. 1 is a schematic cross-sectional view of a copier embodying the present invention.

FIG. 1 shows the principal part of such copying apparatus utilizing a screen in a schematic cross-sectional view in which shown are a screen 1 formed as a drum and means 2 for forming a primary latent image on said screen 1 and comprising for example a corona discharger and optical means for guiding the image of an original to said screen. Inside said screen 1 rotated in the direction of the arrow there is provided a modulating corona discharger 3, which emits a corona ion flow to a rotating insulating drum 4 after imagewise modulation by said screen 1.

The secondary latent image thus formed on said insulating drum 4 is developed by developing means 5, and the resulting developed image on the drum 4 is transferred in a transfer position onto a transfer material under the effect of a bias electric field caused by a transfer corona discharger 6. The insulating drum 4, after the image transfer step, is subjected by cleaning means to the removal of the remaining developer and is used again for the successive formation of the secondary latent image.

The transfer material, after said image transfer, is separated from said drum by separating means, then transported by means of a conveyor belt 8 to fixing means 9, and finally ejected to a tray 10 provided outside the apparatus. 11 indicates the transport path for the transfer material, which is of cut sheet shape in the present embodiment.

The screen-shaped photosensitive member employed in the apparatus shown in FIG. 1 is composed, as disclosed in the U.S. Pat. No. 4,046,466, of a conductive layer, a photoconductive layer and an insulating layer in succession from the inside to the outside of the drum. Said screen, being free from significant attenuation of the primary latent image at the modulation due to the characteristic of the layered structure, is capable of conducting the ion modulation approximately one hundred times with the same primary latent image. The screen is rotated, at the formation of said primary latent image, at a speed limited by the charging time, displacing speed of the optical system, optical response of the photoconductive layer etc. but can be rotated 3 to 6 times faster at the ion modulation in which the modulating corona discharger 3 alone is energized to form the secondary latent image on the insulating drum while other means 2 for the primary latent image formation are deactivated. Consequently the time required for producing 100 copies is approximately 3 times greater if the primary latent image is formed anew for each copy.

Figure 2:
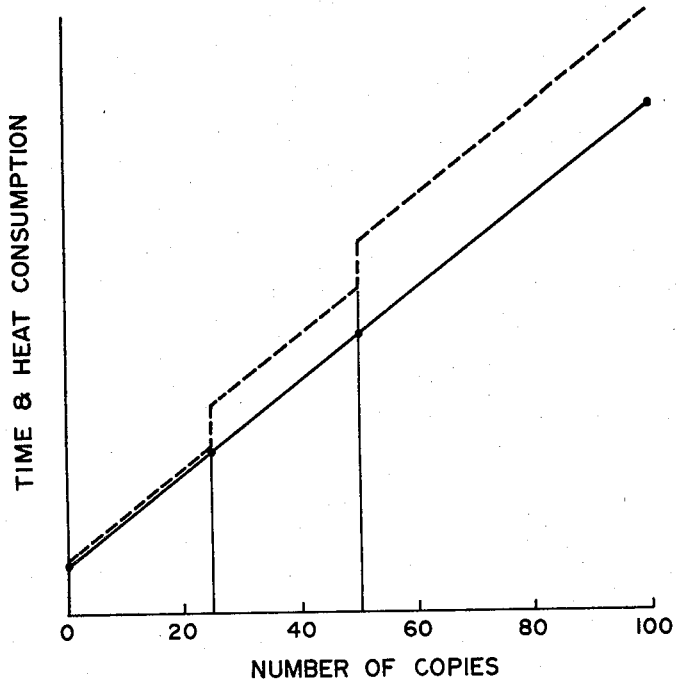
FIG. 2 is a chart showing the consumption of time and heat in relation to the number of copies in a case involving new latent image formations and also in a case where the entire copying is conducted with a same latent image.

FIG. 2 shows the consumption of time and heat in ordinate as a function of the number of copies in abscissa in the copying apparatus shown in FIG. 1 which is assumed to have an ability of making 100 copies from a single primary latent image. The full line indicates the relation in the absence of machine trouble such as paper jamming, while the broken line indicates the proceeding in which the apparatus has the troubles such as paper jams at the 25th and 50th copies and effects the formation of new primary latent images after such troubles are resolved.

The above-mentioned assumption of troubles at the 25th and 50th copies in the course of making 100 copies is practical since no copiers can be completely free from such troubles. In such case, as will be seen from FIG. 2, the conventional copier produces the 1st to 24th copies from the 1st primary latent image, then produces the 25th to 49th copies from the 2nd primary latent image formed anew, and produces the 50th to 100th copies from the 3rd primary latent image. Consequently such copier is substantially equivalent to an apparatus capable of providing 100 copies from three primary latent images.

On the other hand the copying apparatus of the present invention does not effect the formation of a new primary latent image in case of a machine trouble in the course of continuous copying but continues, if the original primary latent image is judged as still usable after said trouble is resolved, the copying operation with said primary latent image, thus eventually obtaining 100 copies from a single primary latent image. In this manner the copying continues up to the 100th copy with only the loss of time for resolving the troubles but without the loss of time for reforming the primary latent image.

However in case such trouble requires a longer period, for example one or two hours, for resolving before the copying operation can be started again, the primary latent image present on the screen will show a lowered potential due to the time-dependent attenuation characteristic of the screen, eventually becoming unable to provide satisfactory images in the copying.

In the copying apparatus embodying the present invention, electric control means such as a timer identifies whether the primary latent image is adequate for reuse, and, for example after the lapse of a tolerable period after which said image becomes unusable, terminates a signal for stopping the primary latent image formation, thereby initiating the remaining copy operation after the primary latent image is formed again. Said tolerable period in which the primary latent image is reusable varies according to the screen composition and the materials used therein, but is preferably limited to approximately 30 minutes in case of a screen having a surfacial insulating layer for bearing the latent image thereon. Consequently the copy process is conducted without formation of a new primary latent image in case the trouble resolving time does not exceed 30 minutes while it is continued after the formation of a new primary latent image in case said resolving period exceeds 30 minutes.

The above-mentioned period for identifying whether or not to form the primary latent image anew is however not necessarily limited to 30 minutes as the rate of attenuation is entirely variable according to the time-dependent characteristic of the screen. In the copying apparatus of the present invention it is advantageous to make a suitable display to indicate the necessity of placing the original under copying again on the original carriage according to whether or not the primary latent image is formed again. Examples of such display in case the reformation of primary latent image is not needed are "Press copy button after the trouble is removed" or simply "Press copy button" since the removal of trouble is self-evident, and those in case the latent image reformation is unnecessary are "Place original" or "Original and Copy button".

Thus, in comparison with the conventional copying apparatus, the copying apparatus of the present invention is capable of reducing the time required for the formation of primary latent image in proportion to the number of machine troubles such as paper jamming if such troubles are resolved within short periods and is advantageous in economizing the time and heat consumption, and is further capable of providing constantly stable image quality by reforming the primary latent image in case such troubles are not resolved within short periods.

The above-mentioned tolerable interruption period for the primary latent image is determined, in case a primary latent image is usable for making for example 100 copies, from the statistical average of the number of paper jams per 100 copies. Since such number of paper jams will not exceed one in the ordinary operation of advancing 100 transfer sheets or so, it will be reasonable to assume one paper jamming in 100 copies. In case of such paper jamming the operation of the apparatus has to be temporarily interrupted to remove the jammed paper from the transport path, during which the primary latent image undergoes an attenuation according to a rate determined by the characteristics of the constituent layers of said screen and the circumferential conditions.

Figure 3:
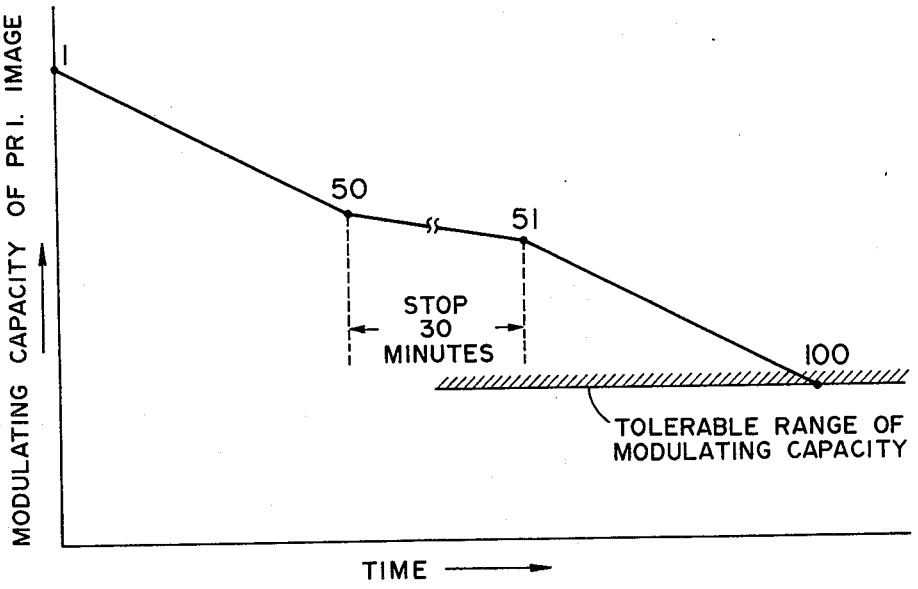
FIGS. 3 to 5 are charts showing the modulating ability of the primary latent image in relation to the functioning time of the apparatus.

The above-mentioned period for determining whether or not to form a new primary latent image is so selected, in consideration of the attenuation of the primary latent image during said interruption, that the copied image obtained by the last 100th modulation is qualitywise acceptable when the copying process is continued after one paper jamming in 100 modulation cycles is resolved. FIG. 3 shows an example of the modulating capacity in ordinate as a function of time in abscissa wherein the copied image obtained by the 100th modulation remains in the tolerable range when a paper jamming at the 50th modulation cycle is resolved within 30 minutes. The reformation of the primary latent image is scarcely needed in the screen of such characteristics if the resolving time for paper jamming does not exceed 30 minutes. The figures shown in the chart indicate the number of modulating cycles.

In this manner the aforementioned object of the present invention can be achieved by selecting a fixed period for determining whether or not to reform the primary latent image. However such process will lead to a drawback as will be explained in the following.

Figure 4:
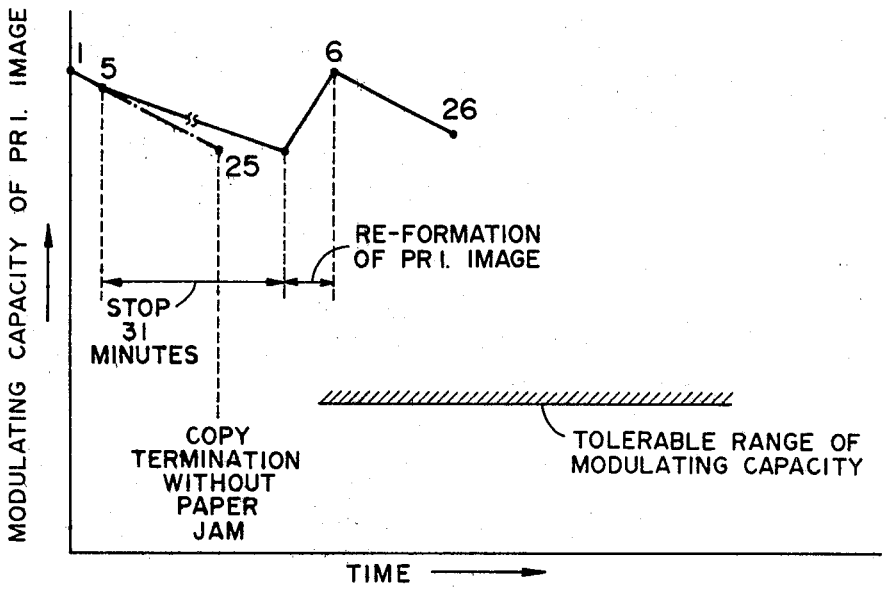

FIG. 4 shows an example of the operation of a copying apparatus utilizing a screen capable of 100 modulations from a single primary latent image for which the interruption period for determining the reformation of the primary latent image is selected as 30 minutes, same as explained before. The curve illustrates a case where the copying operation is set at 25 copies but causes a paper jam at 5th modulation cycle which takes 31 minutes to be resolved. In such case, since the interruption exceeds the predetermined 30 minutes, the apparatus activates the primary latent image forming means to obtain a new primary latent image, by which the 21 remaining copies are obtained. In such case, however, it will be understood that the original primary latent image on the screen still has the modulating capacity of providing such remaining copies at the point where said paper jam is resolved. The figures attached along the curve likewise indicate the number of modulations.

In this manner, as the fixed interruption time for determining the reformation of the primary latent image is to be selected in consideration, for safety, of a case in which the primary latent image is subjected to the maximum number of modulations, the apparatus proceeds to the reformation of the primary latent image on the screen even if the original primary latent image has a modulating capacity within the tolerable range, thus resulting in a waste in the time and energy consumption for latent image reformation.

Such drawback can however by prevented by measuring the interruption period in case the imaging process is interrupted in the course of continuous image formation, converting the thus measured interruption period into the number of modulation cycles corresponding to the attenuation of the primary latent image during said interruption period, subtracting the sum of the number of already completed cycles and the number of thus converted cycles from the preset number of copies, and re-starting the copying operation with or without the reformation of the primary latent image respectively when the result of said subtraction is smaller or larger than the tolerable range of the primary latent image present on the image bearing member.

Such process allows to complete the entire copying operation without reformation of the primary latent image in such situation as illustrated in FIG. 4. It will be understood, in such process, that the identification of whether or not to form a new primary latent image does not depend on a fixed period, since the amount of attenuation of the latent image on the screen is converted into the number of modulations in response to the interruption period.

Figure 5:
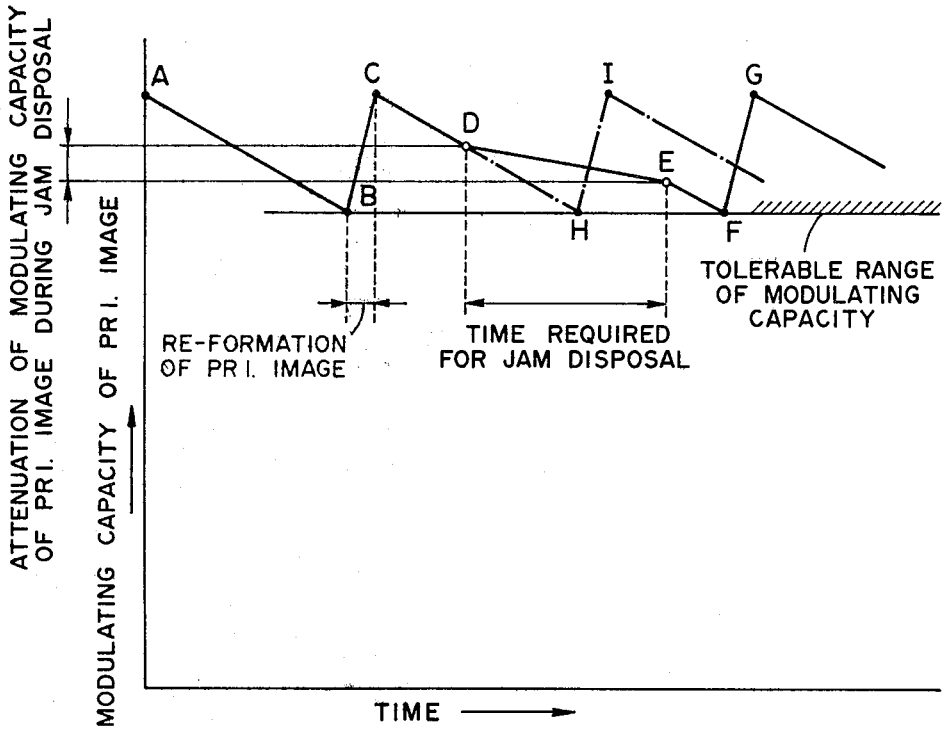

A further improved embodiment of the present invention will now be explained in relation to FIG. 5 showing the modulating capacity of the primary latent image in ordinate as a function of time in abscissa. It is assumed that the copying operation is initiated with a modulating capacity represented by a point A, whereby said modulating capacity becomes attenuated in proportion to the number of modulating cycles and reaches the tolerable limit at a point B, said tolerable limit being determined by the qualitative acceptability of the obtained copy as explained in the foregoing and being convertible into the number of modulation cycles. Upon arrival of the modulating capacity at the point B, the apparatus effects the formation of a new primary latent image and continues the copying operation with the capacity at a point C at a same level as the point A.

It is now assumed that the copying operation is interrupted at a point D for paper jamming or for developer replenishment, which is resolved or completed at a point E. Since the primary latent image shows a faster attenuation during the modulating cycles than in the absence thereof, the inclination in the period D—E is different from that in the period C—D. The apparatus measures the period D−E timer means, then converts thus measured period into the number of modulation cycles corresponding to the attenuation in said measured period, and effects the copying operation from the point E with the existing primary latent image for a number of cycles corresponding to the difference between the remaining number of cycles to the point H if the apparatus was not stopped at the point D and the thus converted number of cycles. The primary latent image reaches the tolerable limit at the point F and is formed anew.

As a numerical example, let us assume that a same primary latent image is capable of modulations 100 times as in the period A−B, that the modulating capacity of the latent image shows an attenuation in interruption of 5 seconds corresponding to one image modulation, and that a paper jam occurs at the 70th modulation and requires an interruption of 50 seconds for resolving. In such case the number of modulations obtainable from the same primary latent image when the copying operation is restarted after said interruption is:

(number of modulations per latent image−number of completed modulations)−(period of interruption/5 sec.)=(100−70)−50/5=20 times.

In comparison with the foregoing example in which a fixed period is selected for identifying whether or not to form a new primary latent image, the present embodiment allows to improve efficiency as the possible number of modulations of the latent image is determined in response to the length of interruption time. In addition while the former process effects the reformation of the primary latent image as soon as the interruption period exceeds the predetermined time even if the latent image is still usable, the latter process is more advanced in recognizing the modulating capacity of the primary latent image from the measurement of the interruption period and identifying thereon whether to continue the modulation cycles or to for a new latent image again.

Also in the former process, as the remaining copying operation is conducted without reformation of the primary latent image if the interruption period does not exceed a fixed time, the points B and H at which the primary latent image is reformed should be positioned higher than the minimum tolerable limit in consideration of the attenuation of the latent image during such interruption, thus leading to the formation of primary latent image in the normal copying operation at an early stage where the preceding latent image still has the modulating capacity. Such drawback is also prevented in the latter process.

Now the function of said latter embodiment will be explained by the flow-chart shown in FIG. 6. In the following explanation the paper jam is cited as the cause of temporary interruption, but it will be understood that a similar function is achieved also for the stops caused by other reasons such as replenishment of transfer materials or developer.

Figure 6:
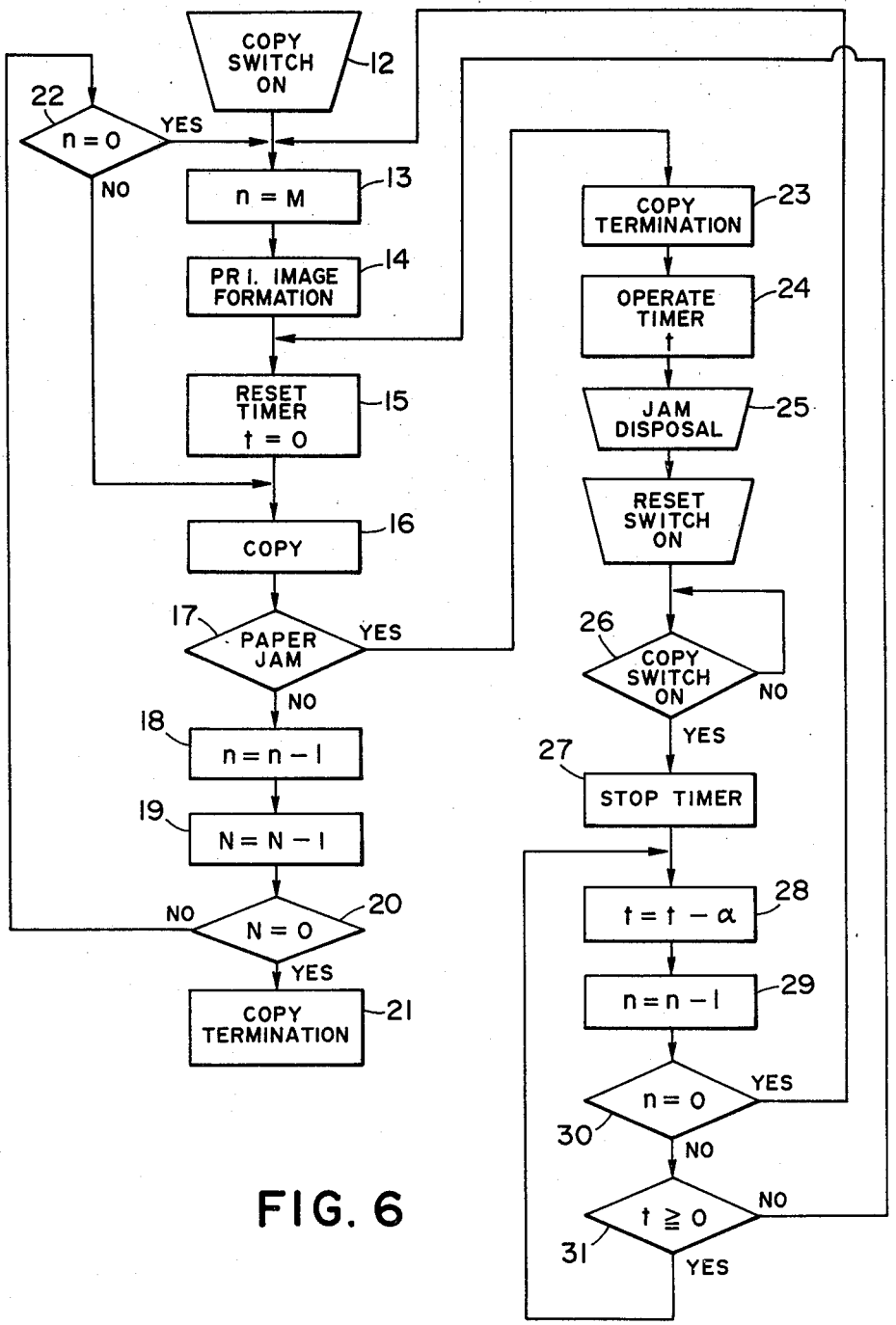
FIG. 6 is a flow chart showing the function of the apparatus of the present invention.

In FIG. 6, M indicates the number of modifications obtainable from a single primary latent image, which is 100 in the foregoing example; N the number of copies to be obtained; n the remaining capacity of modulations obtainable from said primary latent image; t the measured interruption time measured by a timer; and $\alpha$ an interruption time causing an attenuation of the latent image corresponding to one modification, which is 5 seconds in the foregoing example.

In the step 12 a copy start switch is turned on after a desired number of copies is set on the copying apparatus. Then in the step 13 the value n is set at M, indicating that the remaining capacity of the primary latent image is equal to M. In the succeeding step 14 a first primary latent image is formed on the screen, and in the step 15 the timer is reset to $t=0$. The step 16 effects the modulation by said primary latent image on the insulating drum shown in FIG. 1 to obtain a copy image according to the aforementioned process. The step 17 effects identification whether or not a paper jam has occurred in said step 16, and, in case the paper jam is not detector for example by a detector, the program proceeds to the step 18 the value n is reduced to $n-1$ whereby the control unit recognizes that the remaining modulating capacity of the primary latent image is now reduced by one. In the step 19 the value N is reduced to $N-1$ whereby the control unit recognizes that the number of copies to be produced yet is decreased by one. The succeeding step 20 identifies if $N=0$, a condition indicating that all the desired copying operations are completed. In case of $N=0$ indicating that the copying operation is no longer necessary, the program proceeds to the step 21 to terminate the operation. In case of $N\neq 0$ indicating that the copying operation is not yet completed, the program proceeds to the step 22 for identifying if $n=0$, a condition indicating if the primary latent image still has the modulating capacity. In case of $n=0$ indicating that the modulating capacity of the primary latent image has reached the tolerable limit, the program proceeds to the steps 13 and 14 to form a second primary latent image on the screen. In case of $n\neq 0$ indicating the presence of remaining capacity of the primary latent image, the program proceeds to the step 16 to effect the modulation with the same latent image for obtaining a copy.

Now there will be explained the function in case paper jam occurs in the step 17, in which case the program proceeds to a paper jam removal routine, wherein the step 23 interrupts the machine function and the step 23 activates the timer utilizing a random access memory as explained in the foregoing for measuring the time of interruption. The paper jam is resolved at a jam disposal step 25 during said interruption. The succeeding step 26 identifies the turning on of a reset switch after said jam disposal, whereupon the program proceeds to the step 27 to terminate the time measurement by said timer, and then to the steps 28 and 29 to calculate $t=t-\alpha$ and $n=n-1$, respectively. The step 30 is an identification step for the condition $n=0$, and, if $n=0$, the program returns to the steps 13, 14 for forming a new primary latent image in the same manner as $n=0$ is identified in the step 22. In case of $n\neq 0$, the program proceeds to the step 31 to identify if $n\geqq 0$. In case of $t<0$ i.e. the result of calculation $t=t-\alpha$ in the step 28 is negative, the paper jam has been resolved within the aforementioned time $\alpha$. In this case the program proceeds, as the remaining modulating capacity of the primary latent image is reduced by one in the step 29, to the step 15 to reset the timer and then to the step 16 for effecting the modulation cycle with the same primary latent image to obtain a copy, thus without reformation of the primary latent image.

On the other hand, in case $t\geqq 0$ in the step 31 signifying that the attenuation of the primary latent image during the interruption measured by the timer exceeds the attenuation caused by one modulation, the program returns to the step 28. Said returning is made also for the case of $t=0$ in order to ensure that the copying operation is to be in any conducted within the tolerable limit of the primary latent image. Thus the program shown in FIG. 6 proceeds along the cyclic routine of steps 28, 29, 30 and 31 until $n=0$ or $t<0$ is obtained, whereby it is rendered possible to know exactly the modulating capacity of the primary latent image at the restart of the operation after the paper jam disposal to avoid the unnecessary reformation of the primary latent image, and still to effect all the copying operation within the tolerable limit of said modulating capacity.

Although the function explained in the foregoing is based on the number of possible modulations, it is also possible to effect the control on the basis of time. In such case the restart of the copying operation after an interruption is based not on the remaining number of modulations but on the remaining period during which the latent image is usable for modulation.

Also in case the paper jam occurs in the paper path after the image transfer position in the above-explained embodiment, the copies of the desired number can be obtained by adding, at the restart of the copying operation after the interruption, the number of transfer materials removed from said paper path to the initially set number of copies.

What I claim is:

1. An image forming apparatus for forming plural images from a single latent image formed on a latent image bearing member, comprising:

a latent image bearing member;

means for forming a latent image on said latent image bearing member;

means for forming images on other members by means of said latent image formed on said latent image bearing member; and means for measuring a period of interruption of the formation of plural images on said other members; and means for controlling the remaining image formations, after said interruption, to be conducted with or without reformation of a new latent image on said latent image bearing member depending respectively on whether or not the period measured by said period measuring means exceeds a predetermined time limit of duration of said latent image.

2. Am image forming apparatus for forming plural images from a single latent image formed on a latent image bearing member, comprising:

a latent image bearing member;

means for forming a latent image on said latent image bearing member, wherein said latent image attenuates with time;

means for forming images on a selected preset number of other members by means of said latent image formed on said latent image bearing member;

means for measuring a period of interruption of the formation of plural images on said other members, and;

control means for determining whether or not reformation of a new latent image on said latent image bearing member is to be conducted before the start of the remaining plural image formations after said interruption, and for controlling the remaining image formations based on the determination thereof, wherein said control means compares the number of possible image formations from a single latent image on the latent image bearing member, with a sum of the number of the image formations actually performed before the interruption and the number of assumed image formations which would have been obtained during the interruption.

3. An image forming apparatus for forming plural images from a single latent image formed on a latent image bearing member, comprising:

a latent image bearing member;

means for forming a latent image on said latent image bearing member, wherein said latent image attenuates with time;

means for forming images on a selected preset number of other members by means of said latent image formed on said latent image bearing member; and means for measuring a period of interruption of the formation of plural images on said other members;

and further comprising control means for determining whether or not reformation of a new latent image on said latent image bearing member is to be conducted before the start of the remaining plural image formations after said interruption, and controlling the image formations based on the determination thereof, wherein said control means compares the time period required for the number of possible image formations from a single latent image on the latent image bearing member, with a sum of the time period spent by the actual performed image formations before the interruption and the time period required for assumed image formations, obtained by replacing the attenuation period during the interruption with the time period of assumed image formations during the interruption.

4. An apparatus according to claim 2, wherein a latent image is reformed on the latent image bearing member when the selected preset number of images exceeds the number of possible image formations, wherein said reformation occurs when the sum of the number of actual image formations and the number of assumed image formations exceeds the number of possible images.

5. An apparatus according to claim 3, wherein a latent image is reformed on the latent image bearing member when the time for the selected preset number of images exceeds the time for the number of possible image formations, wherein said formation occurs when the sum of the times for the number of actual image formations and the number of assumed image formations exceeds the time for possible images.

* * * * *

UNITED STATES PATENT AND TRADEMARK OFFICE

CERTIFICATE OF CORRECTION

PATENT NO. : 4,381,147

DATED : April 26, 1983

INVENTOR(S) : TOSHIROU KASAMURA

It is certified that error appears in the above-identified patent and that said Letters Patent is hereby corrected as shown below:

COVER PAGE

Before the line beginning "[21]" insert --Assignee: -- CANON KABUSHIKI KAISHA, Tokyo, Japan--.

COLUMN 5

Line 67, delete the word "same".

COLUMN 6

Line 23, "by" should read --be--.

COLUMN 7

Line 38, "for" should read --form--.

COLUMN 8

Line 10, "detector" should read --detected--.

Signed and Sealed this

*Eleventh* Day of *June 1985*

[SEAL]

*Attest:*

DONALD J. QUIGG

*Attesting Officer* *Acting Commissioner of Patents and Trademarks*